US010546687B2

(12) United States Patent
Inoue et al.

(10) Patent No.: US 10,546,687 B2
(45) Date of Patent: Jan. 28, 2020

(54) METHOD FOR CUTTING MOLDED CORE USED FOR COIL COMPONENT

(71) Applicant: SHT Corporation Limited, Izumisano-shi, Osaka (JP)

(72) Inventors: Masafumi Inoue, Izumisano (JP); Yasuomi Takahashi, Izumisano (JP); Tsunetsugu Imanishi, Izumisano (JP); Hitoshi Yoshimori, Izumisano (JP)

(73) Assignee: SHT CORPORATION LIMITED, Osaka (JP)

( * ) Notice: Subject to any disclaimer, the term of this patent is extended or adjusted under 35 U.S.C. 154(b) by 109 days.

(21) Appl. No.: 15/575,628

(22) PCT Filed: Jun. 2, 2016

(86) PCT No.: PCT/JP2016/066367
§ 371 (c)(1),
(2) Date: Nov. 20, 2017

(87) PCT Pub. No.: WO2016/195004
PCT Pub. Date: Dec. 8, 2016

(65) Prior Publication Data

US 2018/0158602 A1 Jun. 7, 2018

(30) Foreign Application Priority Data

Jun. 3, 2015 (JP) ..... 2015-113163

(51) Int. Cl.
*H01F 41/02* (2006.01)
*H01F 27/26* (2006.01)

(52) U.S. Cl.
CPC ..... *H01F 41/0206* (2013.01); *H01F 27/266* (2013.01)

(58) Field of Classification Search
CPC ..... H01F 41/0206; H01F 27/266; H01F 3/14; H01F 17/062; H01F 27/255; H01F 27/24
See application file for complete search history.

(56) References Cited

U.S. PATENT DOCUMENTS

2018/0075955 A1* 3/2018 Takahashi ..... H01F 17/06
2018/0144856 A1* 5/2018 Inoue ..... H01F 17/06

FOREIGN PATENT DOCUMENTS

EP 2 874 161 A1 5/2015
JP 53-029527 3/1978
(Continued)

OTHER PUBLICATIONS

European Patent Office, "Extended European Search Report" (corresp. EP 16803438.7), dated Nov. 23, 2018, 7 pp.
(Continued)

*Primary Examiner* — John C Hong
(74) *Attorney, Agent, or Firm* — Eckert Seamans Cherin & Mellott, LLC

(57) ABSTRACT

A method is described for cutting a plurality of molded cores. Each core includes an annular magnetic body made of a magnetic material and a covering part made of an insulating resin that covers the magnetic body. The method includes coupling each of the molded cores side by side in an axial direction, and cutting the molded cores at a first cutting part and at a second cutting part that transect an outer peripheral surface and an inner peripheral surface and approach each other toward an inner periphery direction of the molded core. The main body has a main body-side first end face formed by cutting at the first cutting part and a main body-side second end face formed by cutting at the second cutting part. A segment has a segment-side first end face formed by cutting at the first cutting part and a segment-side second end face formed by cutting at the second cutting part.

6 Claims, 14 Drawing Sheets

(56) References Cited

FOREIGN PATENT DOCUMENTS

| | | | |
|---|---|---|---|
| JP | 04-206909 | A | 7/1992 |
| JP | 2009 224419 | A | 10/2009 |
| JP | 2011-135091 | A | 7/2011 |
| JP | 2015-103702 | A | 6/2015 |

OTHER PUBLICATIONS

[Machine Translation] Japanese Unexamined Patent Publication 2011-135091, dated Jul 7, 2011, 12 pp.
[Machine Translation] Japanese Patent Application No. 2013-244043 (Japanese Unexamined Patent Publication 2015-103702), dated Apr. 6, 2015, 22 pp.
[Machine Translation] Japanese Unexamined Patent Publication SHO 53-29527, dated Mar. 18, 1978, 4 pp.
[Machine Translation] Japanese Unexamined Patent Publication HEI 04-206909, dated Jul. 28, 1992, 5 pp.
Japanese Patent Office, "International Search Report" (with English language translation), from corresponding publication WO 2016/195004 (PCT/JP2016/066367), dated Aug. 9, 2016, 2 pp.

* cited by examiner

METHOD FOR CUTTING MOLDED CORE USED FOR COIL COMPONENT

TECHNICAL FIELD

The present invention relates to a method for cutting a molded core including a magnetic body for use in coil components that are provided in rectification circuits, noise prevention circuits, resonant circuits and the like in AC devices such as power supply circuits and inverters.

BACKGROUND ART

A coil apparatus that is installed in the circuits of various AC devices includes a coil component consisting of a coil wound around an annular core.

In order to readily wind the coil around the core, a coil component has been proposed in which a core with an opening formed in it portion thereof is formed, a pre-wound air core coil is inserted through this opening, and thereafter a magnetic or nonmagnetic filler is used to backfill the opening and make the opening into a gap (e.g., see FIG. 10 of Patent Document 1).

In contrast, the applicant ha proposed a gapless core in which a molded core pre-formed in an annular shape that includes a magnetic body is cut at two places and a segment is cut out, the segment is fitted into a cutout part formed in the remaining C-shaped body, and respective end faces are abutted against each other (see Patent Document 2).

CITATION LIST

Patent Documents

[Patent Document 1] JP 2011-135091A
[Patent Document 2] JP 2013-244043A

SUMMARY OF INVENTION

Technical Problem

Regarding the molded core proposed in Patent Document 2, the applicant has arrived at enabling manufacturing efficiency to be enhanced as much as possible by collectively cutting a plurality of molded cores.

An object of the present invention is to provide a method for cutting a molded core by which the molded core including the magnetic body are collectively cut and manufacturing efficiency of a coil component and/or a coil apparatus formed by mounting the coil component to the casing can be improved as much as possible.

Solution to Problem

A method for cutting a molded core according to the present invention is the method for cutting a molded core wherein a main body and a segment are obtained by a molded core including an annular magnetic body made of a magnetic material and an insulating resin covering part that covers the magnetic body being cut at a first cutting part and a second cutting part that transect an outer peripheral surface 15 and an inner peripheral surface 17 and approach each other in an inner peripheral direction of the molded core, the main body having a main body-side first end face formed by cutting at the first cutting part and a main body-side second end face formed by cutting at the second cutting part, and the segment having a segment-side first end face formed by cutting at the first cutting part and a segment-side second end face formed by cutting at the second cutting part, a plurality of molded cores are arranged to be coupled such that the side faces are opposing each other, and the plurality of coupled molded cores are cut at the first cutting part and the second cutting part to transect the outer peripheral surface 15 and the inner peripheral surface 17 of the respective molded cores.

The resin covering part has a flange part that projects toward the outer peripheral surface 15 and the side surface, the flange part having an engaging part on one side surface and an engaged part on the other side surface, the molded core is coupled by connecting the engaging part to the engaged part of the molded core provided side by side, and the cutting of the second cutting part is performed against the flange part.

On the resin covering part, a connecting member projects toward the inner peripheral side at a position continuous to the main body-side second end face when cut, the connecting member having an end extending to the center of the molded core that extends in a direction parallel to an axial core of the molded core, wherein one surface is a projection shaft and the other surface has a shaft hole into which the projection shaft is fitted, and the projection shaft of the connecting member is connected to the shaft hole of the molded core provided side by side when the plurality of molded cores are coupled.

One or more ribs project from the side surface of the resin covering part and the ribs are made to abut on the side surface of the molded core provided side by side when the plurality of molded cores are coupled.

The resin covering part has a configuration wherein the area around of the ribs is thinly formed, and the ribs are cut by being pushed after the molded core is cut.

Advantageous Effects of Invention

According to the method for manufacturing a molded core of the present invention, manufacturing efficiency of the coil component can be enhanced as much as possible by collectively cutting a plurality of molded cores.

BRIEF DESCRIPTION OF DRAWINGS

FIG. 22 is a perspective view of the casing mounted with the gapless core.

DESCRIPTION OF EMBODIMENTS

Hereinafter, after first describing a gapped core 10 with reference to the drawings, description will be given with regard to one embodiment of a coil component 50 that uses this gapped core 10 and a coil apparatus 55 in which the coil component 50 is mounted to a casing 70.

Figure 1:
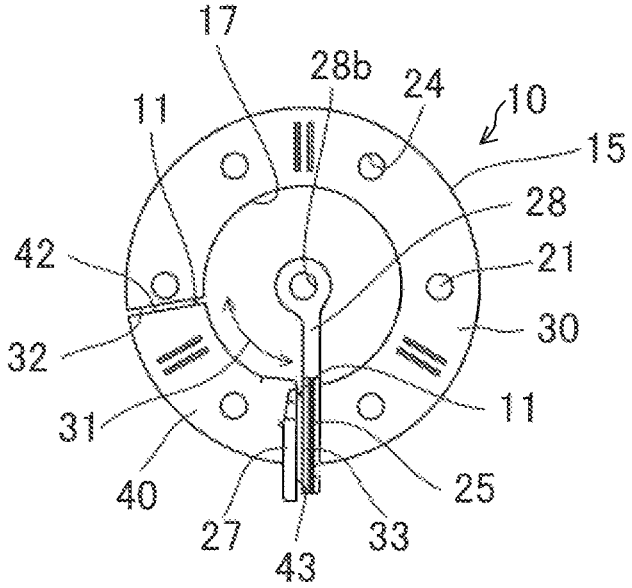
FIG. 1 is a side view of a gapped core of the present invention.
Figure 2:
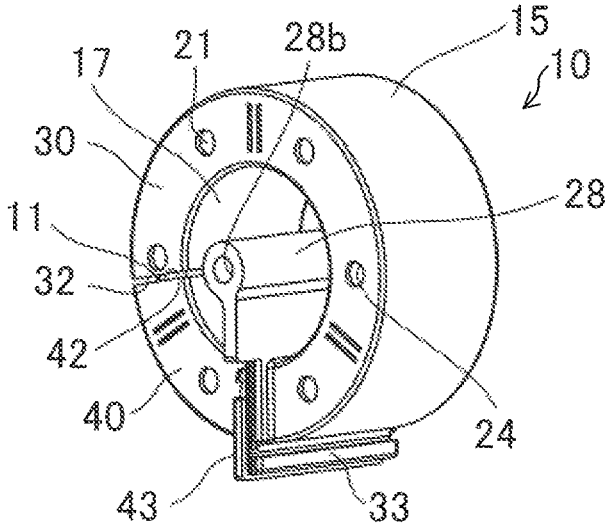
FIG. 2 is a perspective view of the gapped core of the present invention.

FIG. 1 and FIG. 2 are a plan view and a perspective view of the gapped core 10 according to one embodiment of the present invention. The gapped core 10 is constituted by a main body 30 in which a cutout part 31 (range shown by arrows in FIG. 1) is formed in a portion thereof, and a segment 40 that fits into the cutout part 31 of the main body 30.

As shown in FIG. 1, the segment 40 and the cutout part 31 of the main body 30 that results from the segment 40 being cut out are shaped such that respective abutting faces approach each other toward the inner peripheral surface of the main body 30, that is, are substantially fan-shaped. The cutout part 31 of the main body 30 has a main body-side first end face 32 and a main body-side second end face 33 that form end faces, and the segment 40 has a segment-side first end face 42 and a segment side second end face 43 that form end faces.

The segment 40 is inserted into the cutout part 31 of the main body 30 such that the main body-side first end face 32 and the segment-side first end face 42 oppose each other and the main body-side second end face 33 and the segment side second end face 43 oppose each other. The main body-side first end face 32 and the segment-side first end face 42 and the main body-side second end face 33 and the segment-sidle second end face 43 oppose each other across gaps 11 and 11, rather than abutting against each other.

The gapped core 10 having the above configuration can be produced in the following way.

First, a molded cote 20 that includes a magnetic body 21 is produced.

Figure 3:
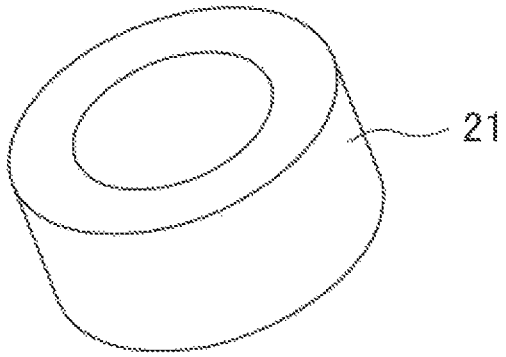
FIG. 3 is a perspective view of a magnetic body.

The molded core 20 is obtained by covering the peripheral surface of the magnetic body 21 made of a magnetic material, as shown in FIG. 3, with an insulating resin covering part 22 as shown in FIG. 4 to FIG. 7.

In FIG. 3, the cross-section of the magnetic body 21 is formed to be substantially rectangular, but the cross-sectional shape of the magnetic body 21 may be circular, elliptical or the like.

Also, the molded core 20 can employ a toroidal shape (circular ring shape), an elliptical ring shape, an oval ring shape, a rectangle ring shape, a teardrop shape, or the like. FIG. 4 to FIG. 7 show a toroidal molded core 20.

As the magnetic material that is employed for the magnetic body 21, an iron based, iron-silicon based, iron-aluminum-silicon based or iron-nickel based material or an iron based or Co based amorphous material can be given as examples. The magnetic body 21 can be configured as a powder compression molded body formed by compressing a powder made of a magnetic material, a molded body of a ferrite core formed by sintering a powder made of a magnetic material, or a laminated core formed by laminating or winding a thin plate made of a magnetic material.

Of these various magnetic materials, the powder compression melded body is favorably employed as the magnetic body 21. This is due to the powder compression molded body having high dimensional accuracy and also high design flexibility.

On the other hand, when the magnetic body 21 composed of a powder compression molded body is cut using a cutting blade (grindstone), the peripheral surface may break up when the cutting blade is applied. In view of this, the molded core 20 can be favorably obtained by insert-molding the magnetic body 21 composed of a powder compression molded body using an insulating resin and forming the resin covering part 22 on the peripheral surface of the magnetic body 21 such as shown in FIG. 4 to FIG. 7. The magnetic body 21 can thereby be prevented from breaking up during cutting. Note that the molded core 20 can also be produced by a resin powder coating method.

On the resin covering part 22, a flange part 23 that projects toward the outer peripheral side and/or the lateral side is formed in a position corresponding to the above-mentioned main body side second end face 33 and segment-side second end face 43. The flange part 23 defines the cutting position as well as serving as a holding part for positioning and fixing a jig of a cutting apparatus, when cutting the molded core 20. Also, as will be discussed later, the flange part 23 is used in order to couple the coil components 50 together, when aligning and collectively cutting the coil components 50.

The flange part 23 forms a main body-side flange part 25 and a segment-side flange part 27 after being cut, with the main body-side flange part 25 serving to position the jig when inserting an air core coil 51 and to retain the air core coil 51. Also, the segment-side flange part 27 serves to retain the air core coil 51 when the segment 40 has been mounted to the main body 30. Furthermore, the main body-side flange part 25 and the segment-side flange pint 27 can be used to position and fix the casing 70, when mounting the coil component 50 to the casing 70.

More specifically, the flange part 23 projects to the outer peripheral side from the resin covering part 22, as well as projecting to the lateral side. On the outer peripheral side of the flange part 23, a main body-side latch part is formed on the side that will become the main body-side flange pint 25. The main body-side latch part in the drawings is a groove 25*a* formed in the width direction of the noun body-side flange part 25.

Also, on the lateral side of the flange part 23, main body-side engaging parts, one of which is a recessed section 25*b* and the other of which is a protruding section 25*c*, are formed on the side that will become the main body-side flange part 25. These main body-side engaging parts engage the main body-side engaging parts of adjacent coil components 50 when collectively cutting the coil components 50, and act to position and prevent rotation of the coil components 50.

Figure 8:
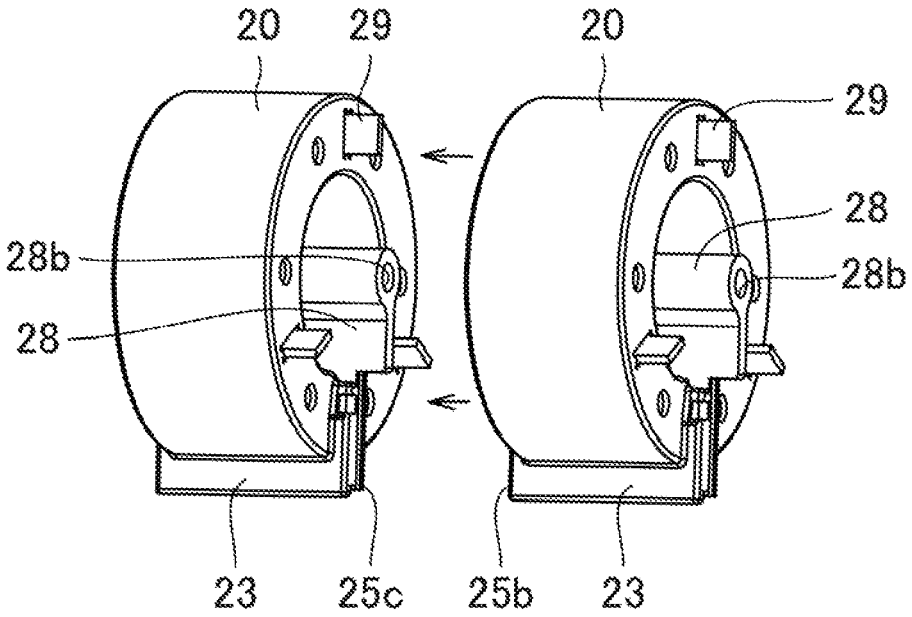
FIG. 8 is a perspective view showing a process of coupling molded cores.
Figure 9:
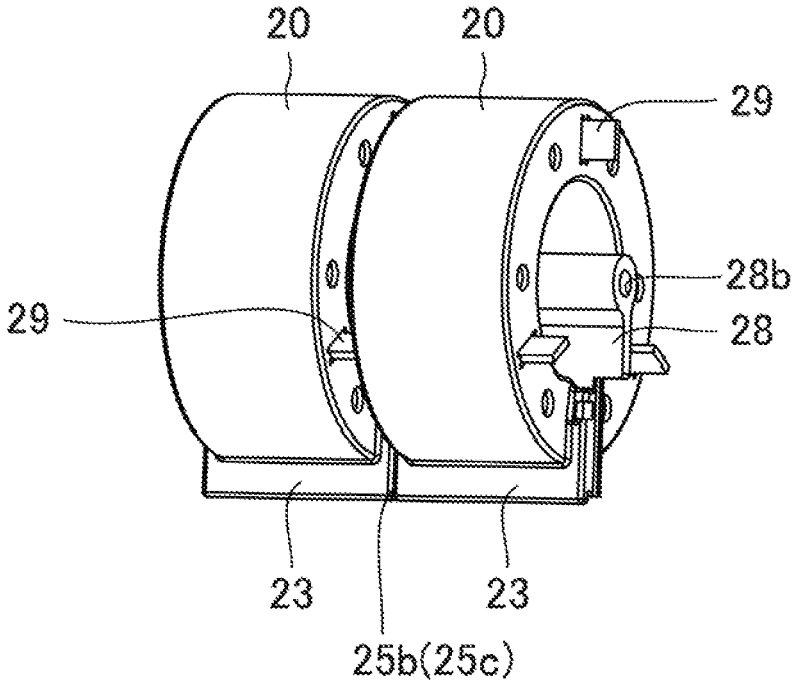
FIG. 9 is a perspective view showing a state in which molded cores are coupled.

On the inner side of the resin covering part 22, a coupling member 28 that extends on the inner peripheral side of the molded core 20 projects on the opposite side to the above mentioned main body-side flange part 25, that is, so as to be continuous with the main body-side second end face 33. The coupling member 28 as shown in FIG. 8 and FIG. 9, engages the adjacent coil component 50 and acts to position the coil components 50, when aligning and collectively cutting the coil components 50. For example, one face of the coupling member 28 can be configured as a protruding shaft 28*a* (see FIG. 7) at the tip that extends to the middle of the molded core 20, and the other face can be configured as a shaft hole 28*b* into which the protruding shaft 28*a* fits.

Also, a plurality of holes 24 are formed in the side surface of the resin covering part 22. These holes are formed by insert pins for positioning the molded core 20 in the mold during insert-molding. These holes 24 can be utilized in mounting an attachment 60 which will be described later.

Figure 4:
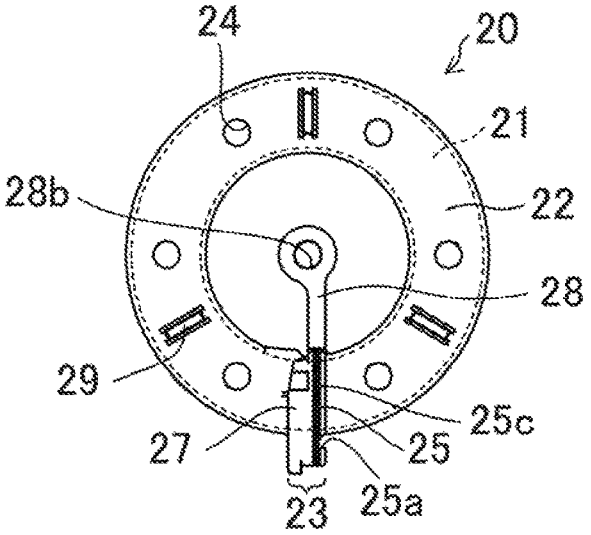
FIG. 4 is a side view of a molded core before cutting.
Figure 5:
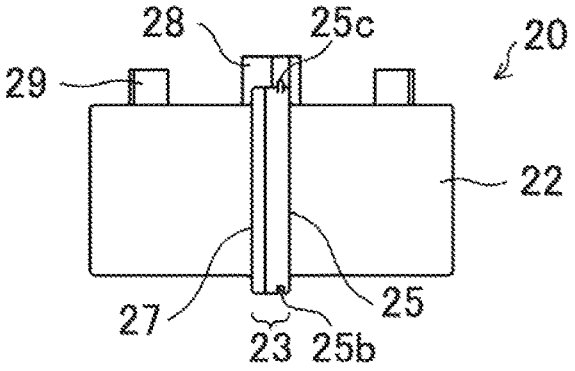
FIG. 5 is a bottom view of the molded core before cutting.
Figure 6:
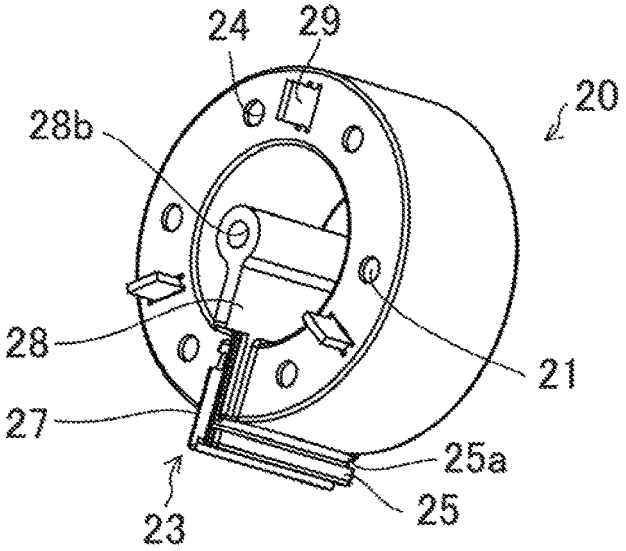
FIG. 6 is a perspective view of the molded core before cutting.

Furthermore, as shown in FIG. 4 to FIG. 6, a plurality of ribs 29 project from one side surface of the resin covering part 22. In the drawings, three ribs 29 project from the resin covering part 22. These ribs 29, as shown in FIG. 8 and FIG. 9 which will be discussed later, act as spacers that secure an interval between molded cores 20 when collectively cutting the molded cores 20.

Note that, desirably, at least one rib 29 each is formed on the main body 30 side and the segment 40 side. In the drawings, there are two ribs 29 on the main body 30 and one rib 29 on the segment 40.

The ribs 29 are only utilized when collectively cutting the molded cures 20, and are not required in the production or configuration of the coil component 50 after cutting. Accordingly, the ribs 29 need to be removed after cutting the molded core 20. In view of this, the ribs 29 are desirably configured such that the area around the ribs 29 is thinly formed, enabling the ribs 29 to be excised simply by being obliquely pushed lightly with a finger.

Figure 7:
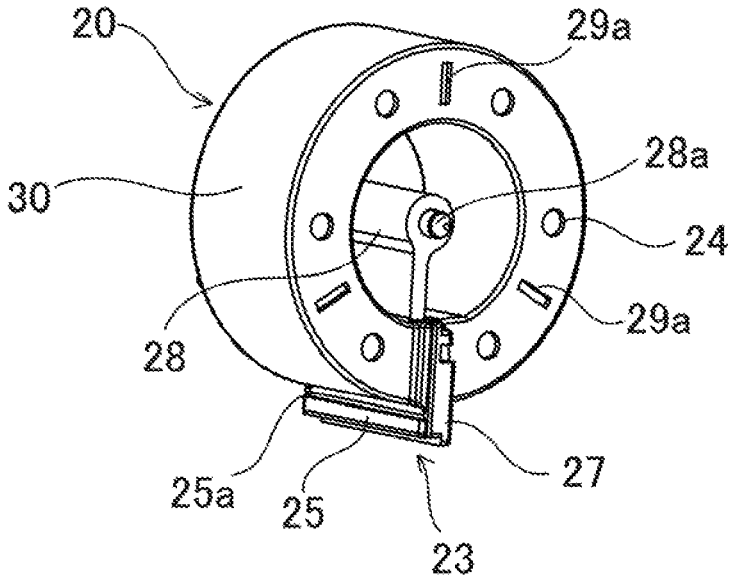
FIG. 7 is a perspective view of the molded core before cutting as seen from the opposite side to FIG. 6.

Also, as shown in FIG. 7, in the resin covering part 22, fitting holes 20*a* into which the ribs 29 fit are provided in the surface on the opposite, side to the ribs 29. Fitting the ribs 29 of the adjacent molded core 20 into the fitting holes 29*a*, when collectively cutting the molded cores 20, thereby enables the molded cores 20 to be positioned, in addition to securing an interval between the molded cores 20.

Figure 10:
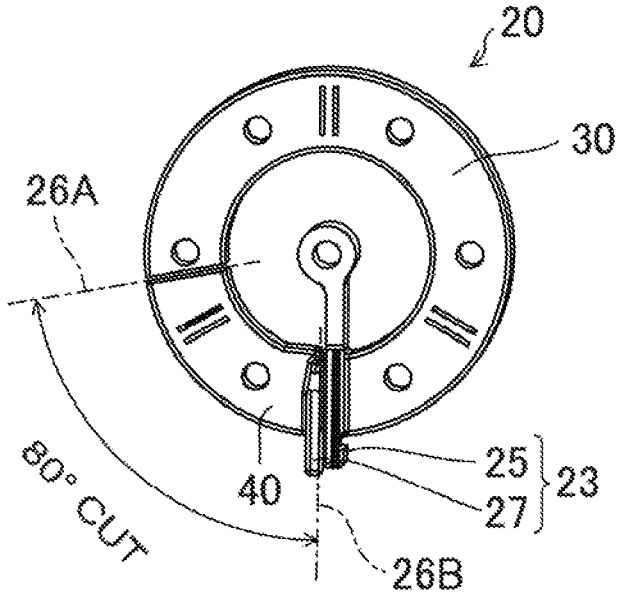
FIG. 10 is a side view showing a process of cutting a molded core.
Figure 11:
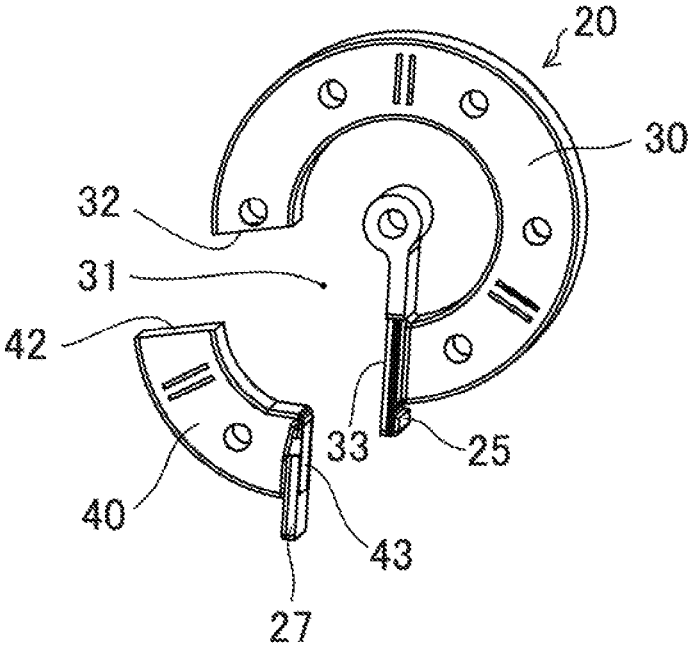
FIG. 11 is at perspective view showing a state in which the molded core has been cut into a main body and a segment.

The molded core 20 hosing the above configuration is cut in two places, as shown in FIG. 10 and FIG. 11, using a cutting blade, and the main body 30 and the segment 40 are separated. Working efficiency is enhanced as much as possible by a plurality of molded cores 20 being coupled side-by-side and collectively cut.

In this case, first, the molded cores 20 are coupled. More specifically, as shown in FIG. 8 and FIG. 9, a plurality of molded cores 20 are aligned side-by-side, with the recessed section 25*b* of the flange part 23 of the molded cores 20 engaged with the protruding section 25*c* of the flange part 23 of the adjacent molded core 20, and the protruding shaft 28*a* of the coupling member 28 engaged with the shaft hole 28*b*. At this time, the ribs 29 abut against the side surface of the adjacent molded core 20, and an interval is secured therebetween. Note that in the case where the fitting holes 29*a* are formed in the resin covering part 22, this configuration is also useful in positioning of the molded cores 20, by fitting the ribs 29 into the fitting holes 29*a* of the adjacent molded core 20.

In the drawings, in order to facilitate description, two molded cores 20 are coupled side-by-side, but as long as there is more than one, the present invention is not limited to two. It is favorable to couple and collectively cut five to ten molded cores 20.

The cutting blade is inserted into the molded cores 20 that are arranged side by side, and the molded cores 20 are cut, as shown in FIG. 10 and FIG. 11. Cutting is implemented in two places, namely, a first cutting part 26A and a second cutting part 26B, such that the molded core 20 is separated into the main body 30 and the segment 40 as a result of the cutting. The second cutting part 26B is implemented in the flange part 23. Cutting at the first cutting part 26A and the second cutting part 26B can also be implemented at the same time, or one may be cut, followed by cutting the other. Desirably, the first cutting part 26A and the second cutting part 26B form an angle of less than or equal to 90 degrees, and the illustrated embodiment is implemented such that the cutting parts form an angle of 80 degrees. Note that although illustration of the ribs 29 is omitted in FIG. 10 and FIG. 11, there is a risk, when the molded core 20 out, that the segment 40 will drop out after cutting is completed. Accordingly, it is desirable, (hiring cutting, to grip the ribs 20 with a jig or the like to prevent the segment from in dropping out, particularly when performing the second cut.

The molded core 20 can be cut using a rotating cutting blade or the like. A metal-bonded diamond wheel can be given as an example of the cutting blade. When cutting the molded core 20, cutting cannot be performed with a zero cutting allowance, and a cutting allowance that depends on the thickness of the cutting blade is required. In other words, the segment 40 is reduced in size by the amount of the cutting allowance, relative to the cutout part 31 of the main body 30 formed by cutting thick molded core 20 and cutting out the segment 40. This cutting allowance corresponds to the gap 11. Accordingly, a cutting blade having a blade thickness that conforms to the width of the gap 13 need only be employed. Desirably, a cutting blade having a blade thickness of 0.5 mm to 1.2 mm or a thin blade of less than 0.7 mm thickness is favorably used.

Note that the gaps 11 and 11 can be made the same width, but may also be different widths. In this case, cutting blades having different blade thicknesses according to the gap widths need only be at the first cutting part 26A and the second cutting part 26B.

Also, in the case where the gap 11 is provided between the main body-side first end face 32 and the segment-side first end face 42 and between the main body-side second end face 33 and the segment side second end face 43, the influence on inductance can be reduced even when the surface roughness of the end faces is degraded compared with a configuration in which the end faces are placed directly against each other. Accordingly, there is an advantage in that the speed with which the cutting blade cuts the melded core 20 is increased, enabling the efficiency of the cutting operation to be improved.

As a result of the cutting, the molded core 20 is separated into the main body 30 having the cutout part 31 formed, by cutting out the segment 40 and the substantially fan-like segment 40.

As shown in FIG. 11, the main body 30 formed by cutting out the segment 40 is a substantially C-shaped member having the main body-side first end face 32 formed by cutting at the first cutting part 26A and the main body-side second end face 33 formed by cutting at the second cutting part 26B, and in which is formed the cutout part 31 having an interval equal to the amount of the segment 40 that was cut out and the cutting allowance, between the main body-side first end face 32 and the main body-side second end face 33. In the cutout part 31, the main body-side first end face 32 and, the main body-side second end face 33 approach each other in the inner peripheral direction, and the angle formed by the main body-side first end face 32 and the main body-side second end face 33 is the same as the angle formed by the first cutting part 26A and the second cutting part 26B toward the inner peripheral side of the molded core 20.

As similarly shown in FIG. 11, the segment 40 is also a substantially fan-shaped member having the segment-side first end face 42 formed by cutting at the first cutting part 26A and the segment-side second end face 43 formed by cutting at the second cutting part 26B, and in which the segment-side first end face 42 and the segment-side second end face 43 approach each other in the inner peripheral direction. The angle formed by the segment-side first end face 42 and the segment-side second end face 43 of the segment 40 is the same as the angle formed by the first cutting part 26A and the second cutting part 26B toward the inner peripheral side of the molded core 20.

After cutting the molded core 20, the ribs 29, which are no longer required, are excised. The ribs 29 can be readily excised simply by being obliquely pushed lightly with a finger, due to the periphery thereof being thinly formed. The main body 30 and the segment 40 with the ribs 29 excised are shown in the aforementioned FIG. 1 and FIG. 2.

The gapped core 10 in which the cutting allowance forms the gap 11 can be obtained, as shown in FIG. 1 and FIG. 2, by inserting the segment 40 into the cutout part 31, with respect to the obtained main body 30.

In the gapped core 10, the gap 11 can be secured by inserting a no spacer between the main body 30 and the segment 40.

Figure 12:
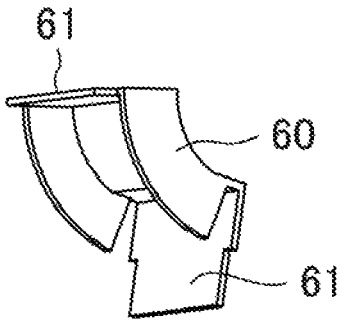
FIG. 12 is a perspective view of an attachment that is mounted on the segment.
Figure 13:
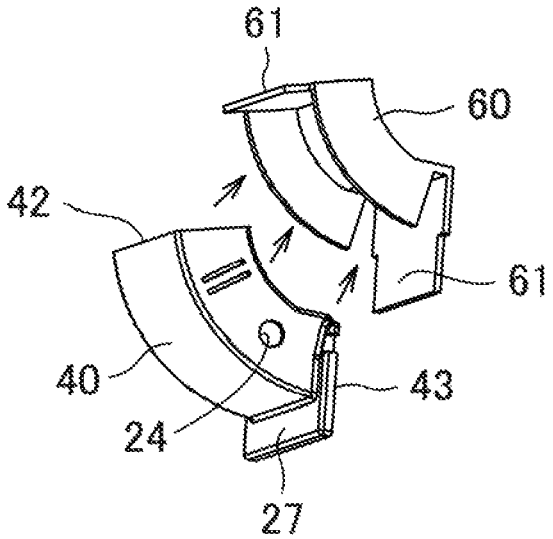
FIG. 13 is a perspective view showing a process of mounting the attachment on the segment.

For example, the spacer, as shown in FIG. 12 or FIG. 13, can be integrated with the segment 10, by being made into the shape of an attachment 60 that couples two resin plates 61 and 61 that abut against the segment-side first end face 12 and the segment-side second end face 43 of the segment 40 along the inner peripheral side and the lateral side of the segment 10, enabling handling of the segment 10 to be facilitated. At this time, although illustration is omitted, a boss that fits into the hole 24 of the segment 40 that is formed by an insert pin projects from the inner side surface of the attachment 60, and the attachment 60 can be readily mounted on the segment 40 by fitting the boss into the hole 24.

Figure 14:
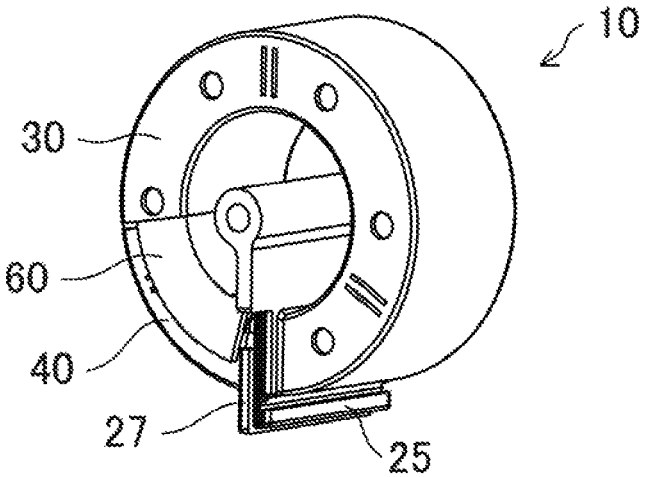
FIG. 14 is a perspective view of a gapped core in which the segment with the attachment mounted thereon is mounted to the main body.
Figure 15:
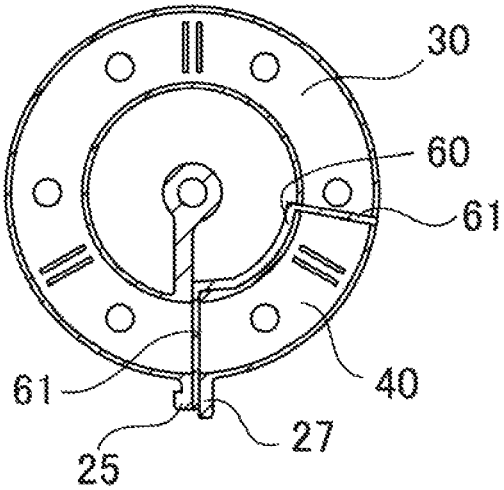
FIG. 15 is a cross-sectional view of a resin covering part of the gapped core.

FIG. 14 shows a perspective view in which the segment 40 to which the attachment 60 is attached from the inner peripheral side is mounted to the main body 30, and FIG. 15 shows a cross-sectional view of the resin covering part 22. Referring to FIG. 15, it is evident that the resin plates 61 and 61 are interposed in positions where the end faces of the main body 30 and the segment 40 oppose each other.

Figure 16:
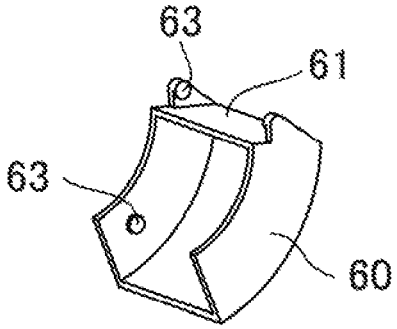
FIG. 16 is a perspective view of the attachment of a different embodiment.
Figure 17:
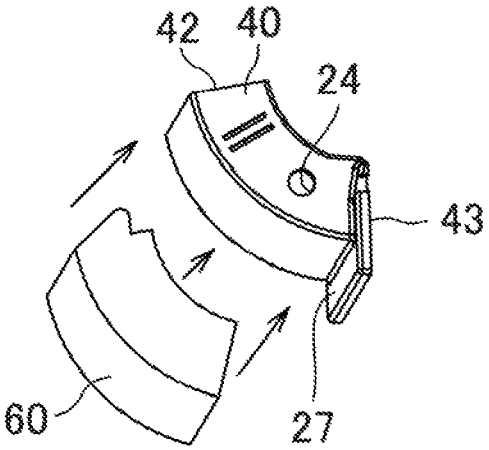
FIG. 17 is a perspective view showing a process of mounting the attachment of FIG. 16 on the segment.
Figure 18:
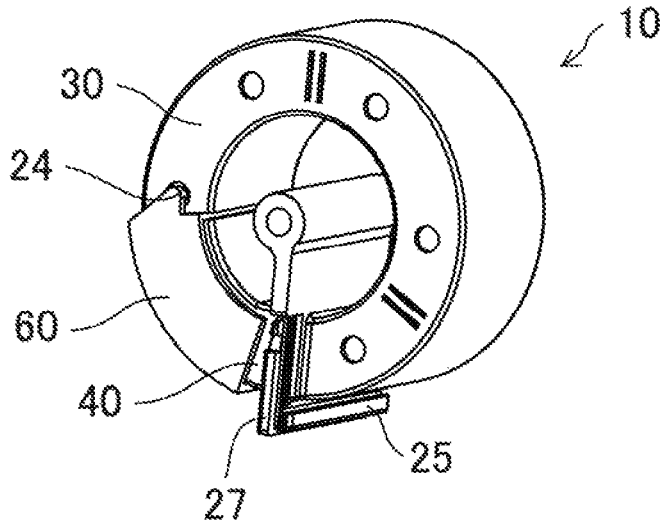
FIG. 18 is a perspective view of the gapped core in which the segment with the attachment of FIG. 16 mounted thereon is mounted to the main body.

Note that in the case of mounting the attachment 60 on the outer peripheral side of the segment 40, the segment-side flange part 27 will be get in the way, and that a configuration need only be adopted in which, in the attachment 60, a resin plate 61 that abuts the segment-side first end face 42 is integrally formed so as to cover the outer peripheral side and the lateral side of the segment 40 as shown in FIG. 16 to FIG. 18, and, at the segment-side second end face 43, the gap 11 is secured by separately adhering a resin plate or with an interval holding member 76 of the casing 70 which will be discussed later.

Also, the attachment 60 can be readily mounted on the segment 40, by configuring the side surface of the attachment 60 such that a boss 63 fits into a hole 24 formed in the segment 40 by an insert pin, as shown in FIG. 16 to FIG. 18. Also, the segment 40 can be readily mounted to the main body 30, by adopting a configuration in which the attachment 60 extends beyond the segment side first end face 42, a boss 63 is formed on the inner surface thereof, and the boss 63 fits into a hole 24 formed in the main body 30 by an insert pin.

Because the segment 40 is cut out from the main body 30, the main body 30 and the segment 40 possess the same magnetic characteristics and the like. Accordingly, magnetic characteristics and the like that are extremely stable compared with the case where the segment is formed from a different member can be exhibited.

Furthermore, because the segment 40 cut out from the molded core 20 is put back in the cutout part 31 of the main body 30, the process of forming a segment from a different member can be rendered unnecessary, and, in addition, manufacturing efficiency can be enhanced as much as possible, with almost no loss of raw materials.

Also, the width of the gap 11 can be adjusted by the thickness of the cutting blade.

Figure 19:
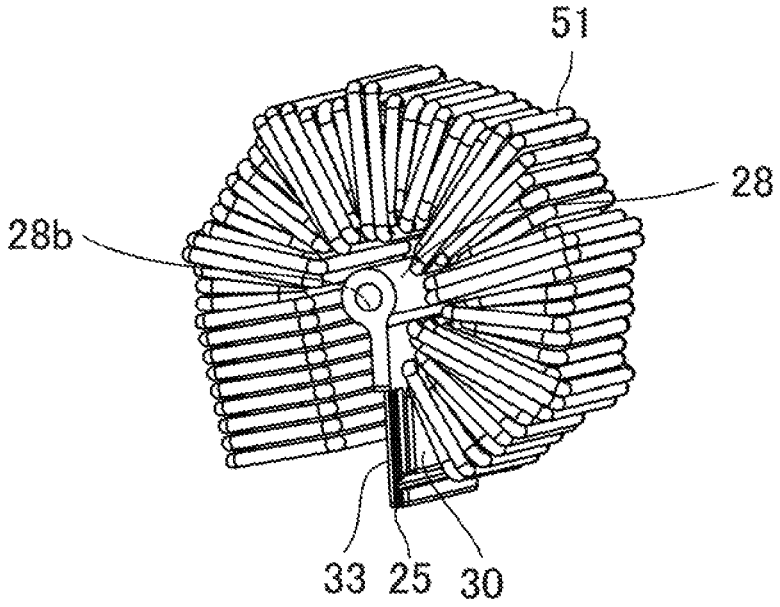
FIG. 19 is a perspective view showing a process of inserting an air core coil in the main body.

A method for manufacturing a coil component 50 that utilizes the above gapped core 10 be described. First, after cutting out the segment 10 from the molded core 20 (FIG. 11), the pre-wound core coil 51 is inserted from the main body-side first end face 22 of the main body 20. FIG. 19 shows a state in which the air core coil 51 is inserted in the main body 30.

Note that in the case of using a coil insertion apparatus when inserting the air core coil 51 into the main body 30, the main body 30 can be fixed so as to not be rotatable, by positioning the protruding shaft 28*a* (see FIG. 7) and the shaft hole 28*b* of the coupling member 28 in the apparatus, and holding the main body-side flange part 25 with a jig. The air core coil 51 can be inserted in this state. The main body-side flange part 25 projects from the main body 30, and thus serves to retain the air core coil 51.

Figure 20:
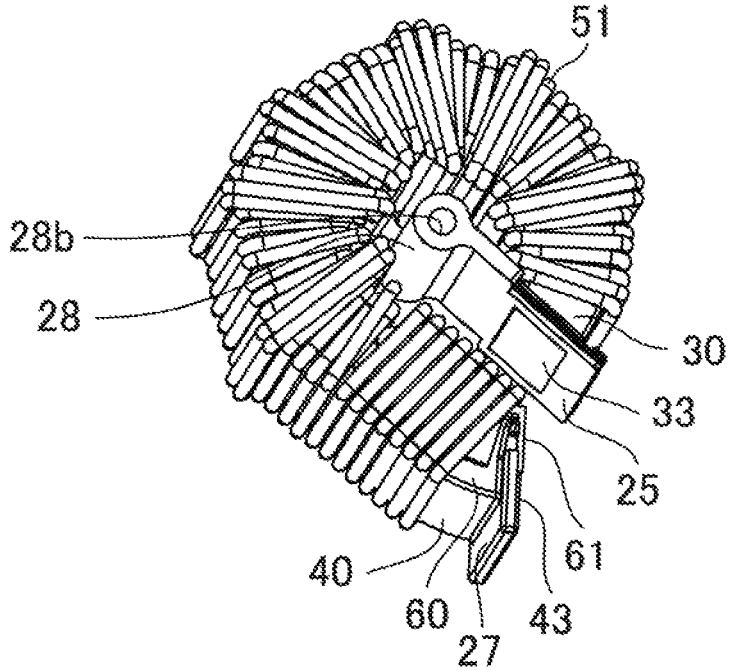
FIG. 20 is a perspective view showing a process of inserting the segment with the attachment mounted thereon into the main body in which the air core coil is inserted.
Figure 21:
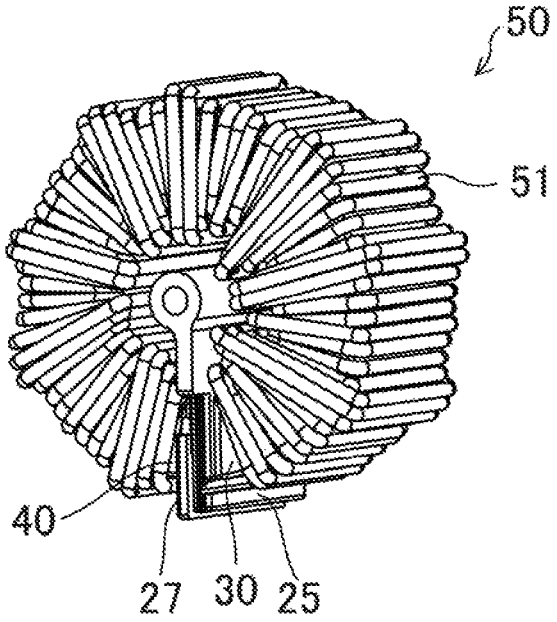
FIG. 21 is a perspective view of a core component in which the air core coil is fitted in the gapped core.

The cod component 50 is produced by the segment 40 with the attachment 60 mounted thereon being inserted into the cutout part 31 of the main body 30 and fixed, as shown in FIG. 20 and FIG. 21, after the air core coil 51 has been inserted into the main body 30. Note that FIG. 20 and FIG. 21 show exemplary insertion of the segment. 40 with the attachment 60 shown in FIG. 12 to FIG. 15 mounted thereon. The segment 40 can be fixed to the main body 30, by respectively applying an adhesive to the resin plates 61 and 61 (spacers) of the attachment. 60 that oppose the main body-side first end face 32 and the main body-side second end face 33.

In the case of not using the attachment 60, the segment 40 need only be inserted into the cutout part 31 of the main body 30 after respectively adhering and fixing the resin plates 61 and 61 as spacers to the segment-side first end face 42 and the segment-side second end face 43 of the segment 40.

According to the above description, the main body 30 and the segment 40 are annular, and, as shown in FIG. 21, form the wound coil component 50 of the air core coil 51.

Figure 27:
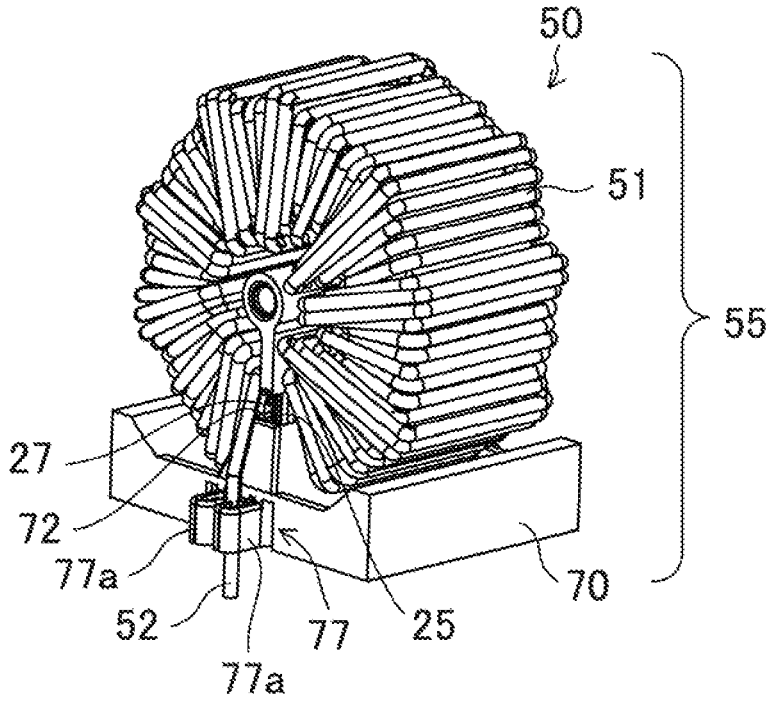
FIG. 27 is a perspective view of a core apparatus according to the present invention.

The coil component 50 that is produced is mounted to the casing 70, which is for mounting to a substrate or the like, to form a coil apparatus 55 such as shown in FIG. 27.

Figure 22:
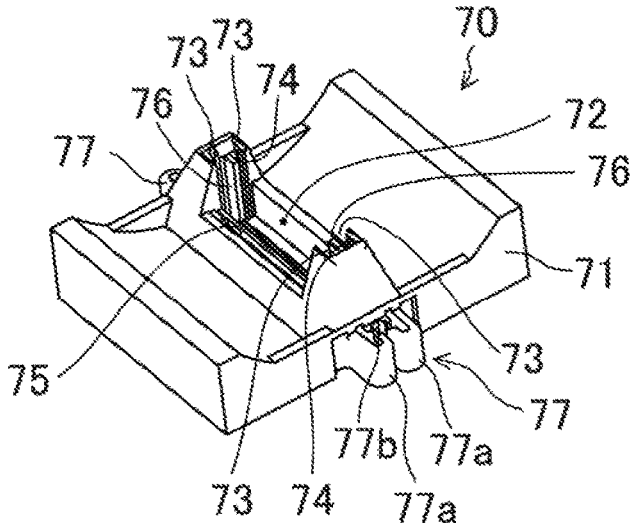
FIG. 22 is a perspective view of a casing for mounting the core component.
Figure 23:
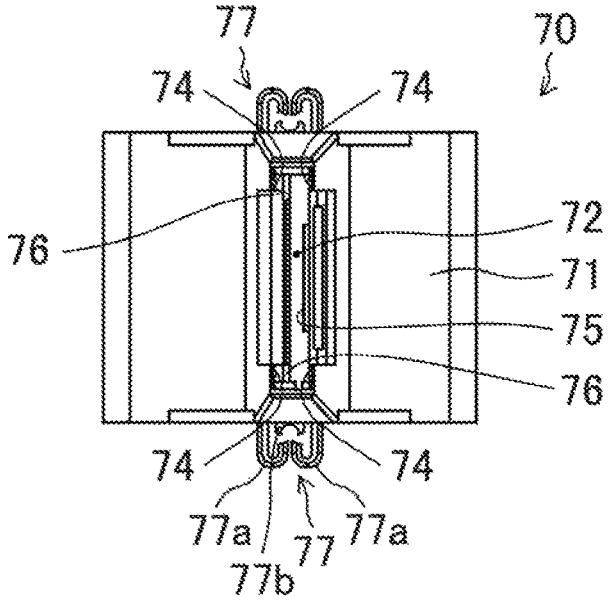
FIG. 23 is a plan view of the casing.
Figure 24:
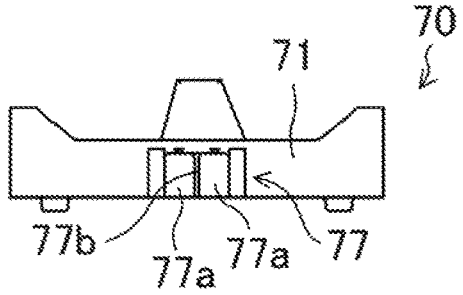
FIG. 24 is a side view of the casing.

FIG. 22 to FIG. 24 show the casing 70 to which the coil component 50 is mounted. The casing 70 is constituted by a base 71 that becomes lower toward the center, in conformity with the outer peripheral shape of the coil component 50 serving as a substrate.

The middle of the base 71 has walls whose side surfaces project upward, and on the inner surfaces of these walls is formed a flange fixing part for mounting the main body-side flange part 25 and the segment-side flange part 27 of the coil component 50. The flange fixing part, in the present embodiment, is a recess 72. The main body-side flange part 25 and the segment-side flange part 27 are inserted into this recess 12 and fixed.

A guide 73 that guides the side surfaces of the main body-side flange part 25 and the segment-side flange part 27 is recessed on both sides of the recess 72, and pressing pieces 74 and 74 that inwardly press the main body-side flange part 25 and the segment-side flange part 27 project from surfaces opposing the main body side flange part 25 and the segment-side flange part 27. The pressing pieces 74 and 74 that are illustrated are two protruding sections parallel to the insertion direction of the main body-side flange part 25 and the segment-side flange part 21.

Furthermore, a casing-side latching part that engages the main body-side latch part that is formed on the main body-side flange part 25 projects from the inner surface of the recess 72. In the case where the main body-side latch part is the groove 25*a*, the casing-side latching part cab be configured as a latching piece 75 that projects so as to fit into the groove 25*a*.

Also, a space occurs between the main body-side flange part 25 and the segment-side flange part 27 as a result of configuring the gap 11. An interval holding member 76 that fits into this space and maintains the interval between the main body-side flange part 25 and the segment-side flange part 27 projects in the recess 12.

Also, in the casing 70, holding means 77 and 77 that hold leader fines 52 and 52 (see FIG. 27) of the air core coil 51 project from the side surface of the base 11. The holding means 77 is equipped with insertion parts 77*a* and 77*a* that each curve inwardly and have elasticity, and a receiving part 77*b* that passes the leader line 52 between the tips of these insertion parts 77*a* and 77*a* and holds the leader line 52. As a result of inserting the leader line 52 between the insertion parts 77*a* and 77*a*, the insertion parts 77*a* and 77*a* elastically deform to allow the leader line 52 to pass through, and the leader line 52, having passed through the insertion parts 77*a* and 77*a*, fits between the tips of insertion part 77*a* and 77*a* and the receiving part 77*b* and is held.

Figure 25:
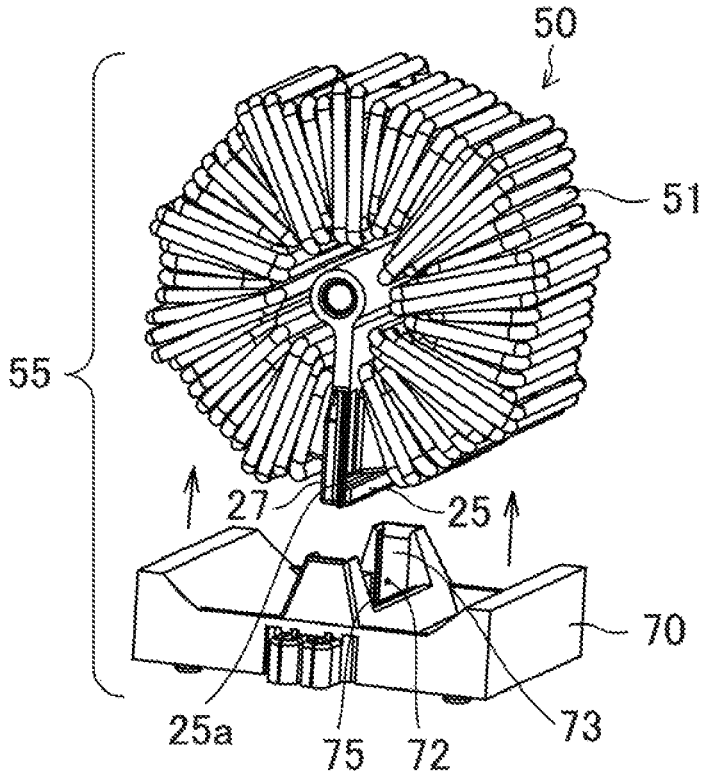
FIG. 25 is a perspective view showing a process of mounting the core component to the casing.
Figure 26:
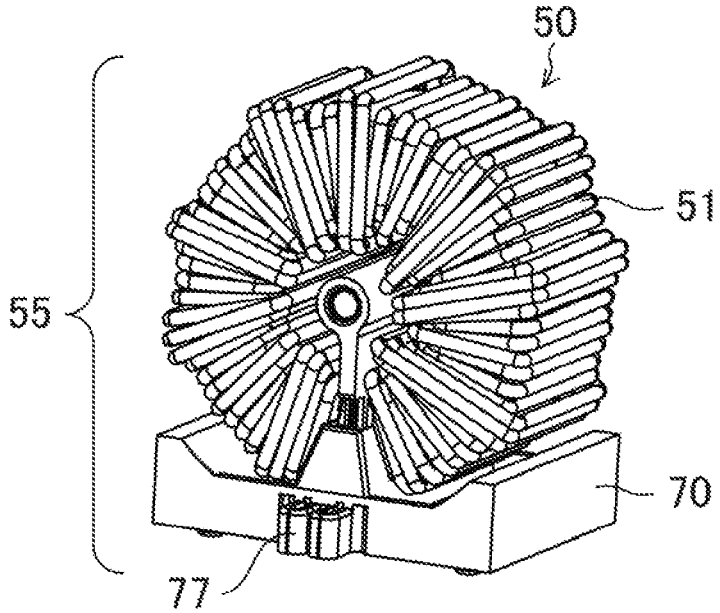
FIG. 26 is a perspective view showing a state in which the core component is mounted to the casing.

The coil apparatus 55 is formed as shown in FIG. 26, by mounting the coil component 50, as shown in FIG. 25, to the casing 70 having the above configuration. The coil component 50 is attached to the casing 70 by inserting the main body-side flange part 25 and the segment-side flange part 27 into the recess 72 which serves as the flange fixing part. More specifically, by pushing both sides of the main body-side flange part 25 and the segment-side flange part 27 through the guide 73, the main body-side flange part 25 and the segment-side flange part 27 fit into the recess 72, and are inserted while being pressed by the pressing pieces 74 and 74. Also, the interval holding member 76 projecting from the bottom surface of the recess 72 fits between the main body-side flange part 25 and the segment-side flange part 27.

As a result of the groove 25*a*, which is the main body-side latch part that is formed in the main body-side flange part 25, fitting into the latching piece 75, which is the casing-side latching part, the coil component 50 is prevented from dropping out into the casing 70.

Next, the coil apparatus 55 can be obtained, as shown in FIG. 27, by respectively inserting the leader lines 52 and 52 of the air core coil 51 into the holding means 77 and 77.

Although the gapped core 10 is described in the above-mentioned embodiment, the present invention can be applied to the gapless core 13 wherein the main body-side first end face 32 and the segment-side first end face 42, and the main body-side second end face 33 and the segment-side second end face 43 are placed against each other, respectively, without a gap. That is, the method for cutting the molded core 20 mentioned above can be employed for the gapless core 13.

Figure 28:
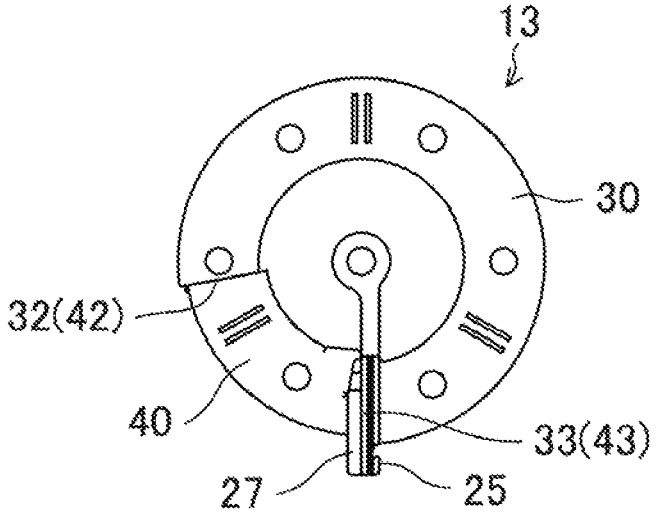
FIG. 28 is a side view of a molded core for a gapless core.
Figure 29:
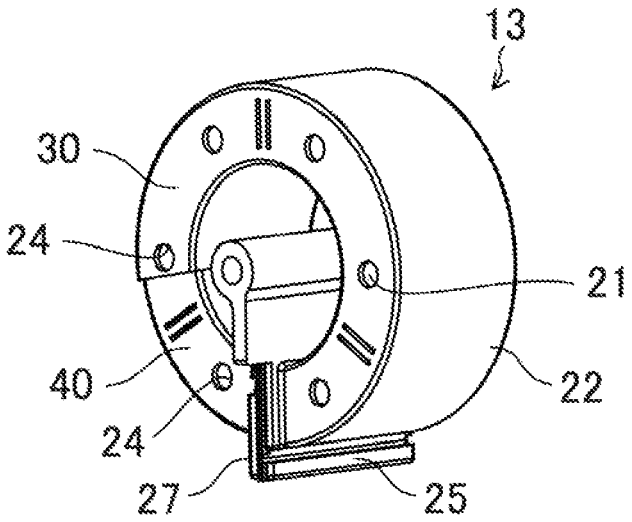
FIG. 29 is a per view of the molded core for the gapless core.

In this case, as shown FIG. 28 and FIG. 29, the main body-side first end face 32 and the segment-side first end face 42 are closely attached, and the main body-side second end face 33 and the segment-side second end face 43 are closely attached by pushing the segment 40 into an inner peripheral side of the cutout part 31 of the main body 30. The segment 40 is pushed slightly inward from the main body 30. However, when assembled as the coil component 50 or the coil apparatus 55, magnetic flux passing inside the magnetic body 21 passes on an inner peripheral side of the magnetic body 21, which is the shortest magnetic path, and therefore, even when the cross sectional area of the outer peripheral side is lacked, the cross sectional area is not substantially reduced, stable inductance characteristics can be exhibited and magnetic characteristics are hardly decreased.

Figure 30:
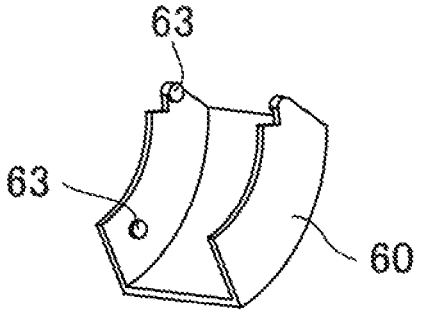
FIG. 30 is a perspective view of the attachment that is mounted on the segment for the gapless core.
Figure 31:
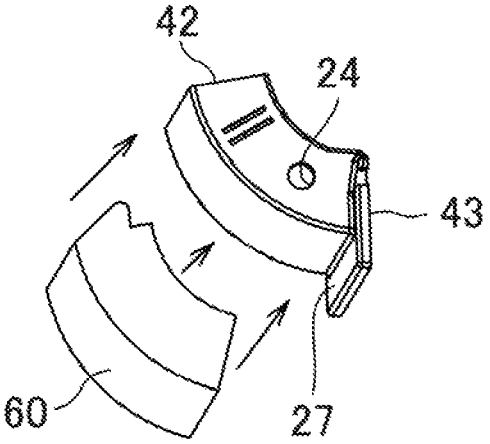
FIG. 31 is a perspective view showing a process of mounting the attachment of FIG. 30 on the segment.

FIG. 30 shows the attachment 60 of the segment 40 employed for the gapless core 13. The attachment 60 covers only the side face and the inner face of the segment 40, and the segment-side first end face 42 and the segment side second end face 43 are exposed. In the same manner as the above-mentioned embodiment, the boss 63 fitted into the hole 24 formed in the resin covering part 22 by insert pins projects in the attachment 60, and the attachment 60 can be mounted on the segment 40 by fitting the boss 63 into the hole 24 as shown in FIG. 31. Also, when the segment 40 is mounted on the main body 30, the boss 63 of the extended part longer than the segment 40 can be fitted into the hole 24 of the main body 30.

Figure 32:
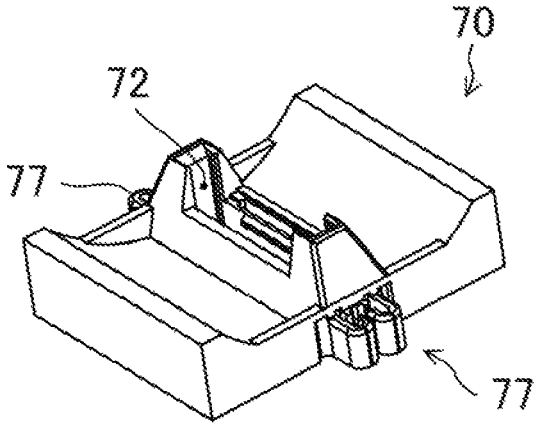
Figure 33:
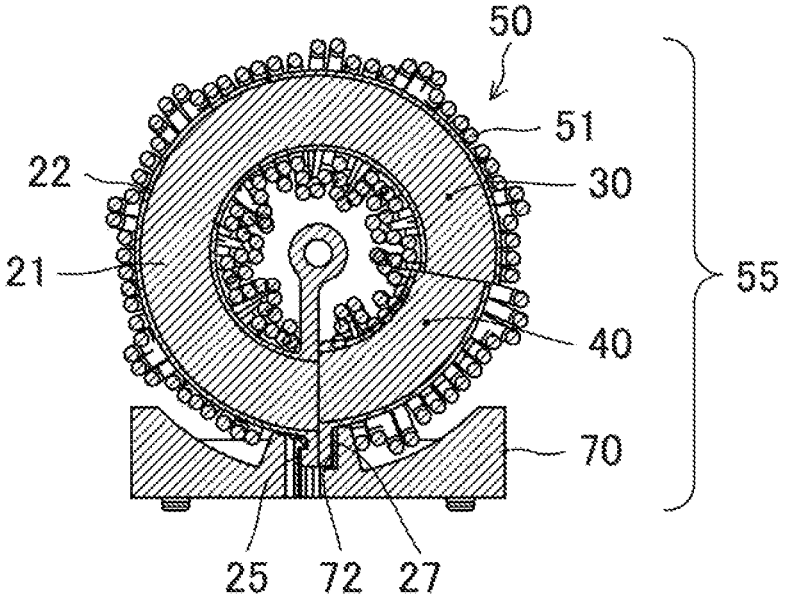
FIG. 33 is a cross-sectional view of the core apparatus wherein the core component composed of the gapless core are mounted on the casing.

Also, the process of producing the coil apparatus 55 by mounting the coil component 50 on the casing 70 is the same as the above-mentioned embodiment. FIG. 33 shows the cross-sectional view of the produced coil apparatus 55. In this case, the recess 72 of the casing 70 may be formed to narrow by the width of unnecessary gap as shown in FIG. 32.

The above description is for describing the present invention, and should not be understood as limiting the described invention to the claims or restricting the scope thereof. Also, the configuration of each element of the present invention is not limited to the above embodiment, and can of course be variously modified within the technical scope defined by the claims.

For example, in the case of producing a plurality of molded cores 20 having the same shape, the segment 40 can also be put back in another main body 30, rather than being put back in the main body 30 from which the segment 40 was cut out.

Also, although, in the above embodiment, a configuration is adopted in which the main body-side first end face 32 and the segment-side first end face 42 are opposed to each other and the main body-side second end face 33 and the segment-side second end face 43 are opposed to each other, a configuration may be adopted in which the main body-side first end face 32 and the segment side second end face 43 are opposed to each other and the main body-side second end face 33 and the segment-side first end face 42 are opposed to each other.

In addition, although the above embodiment describes the gapped core 10 wherein the gaps 11 and 11 are respectively provided between the main body-side first end face 32 and the segment-side first end face 12 and between the main body side second end face 33 and the segment-side second end face 43 and the gapless core 13 wherein every end face is placed against each other, a configuration may be adopted in which the gap 11 is formed between only two of the end faces, and the other two end faces are placed against each other without a gap.

For example, by adopting a configuration in which the main body-side first end face 32 and the segment-side first end face 42 are placed against each other without a gap and the gap 11 is provided between the main body-side second end face 33 and the segment-side second end face 43, the occurrence of leakage magnetic flux within the coil 51 can be suppressed. As a result, magnetic flux linked with the coil 51 decreases, enabling eddy current loss to be reduced and be generation to be suppressed.

Also, by adopting a configuration, opposite to the above, in which the main body-side second end face 33 and the segment-side second end face 43 are placed against each other without a gap, and the gap 11 is provided between the main body-side first end face 32 and the segment-side first end face 42, initial inductance decreases, but reduction of saturation magnetic characteristic can be suppressed and there is an advantage in that the slope of the DC bias characteristics can be reduced.

LIST OF REFERENCE NUMERALS (10) Gapped core
(11) Gap
(20) Molded core
(25) Main body-side flange part
(27) Segment-side flange part
(30) Main body
(31) Cutout part
(32) Main body-side first end face
(33) Main body-side second end face
(40) Segment
(42) Segment-side first end face
(43) Segment-side second end face
(50) Coil component
(51) Air core coil
(55) Coil apparatus
(70) Casing

The invention claimed is:

1. A method for cutting a plurality of molded cores, the method comprising:

preparing the plurality of the molded cores, each core including an annular magnetic body made of a magnetic material, and a covering part made of an electrically insulating resin material for covering the annular magnetic body;

coupling each of the molded cores side by side in an axial direction thereof; and cutting the coupled molded cores at a first cutting part and a second cutting part that transect an outer peripheral surface and an inner peripheral surface of the molded cores and approach each other in an inner peripheral direction of the molded cores, to thereby produce a substantially C-shaped main body and an ark-like segment, the main body having a main body-side first end face formed by cutting at the first cutting part and a main body-side second end face formed by cutting at the second cutting part, and the segment having a segment-side first end face formed by cutting at the first cutting part and a segment-side second end face formed by cutting at the second cutting part.

2. The method for cutting a molded core according to claim 1, wherein the resin covering part has a flange part that projects toward the outer peripheral surface and the side surface, the flange part having an engaging part on one side surface and an engaged part on the other side surface, wherein the molded core is coupled by connecting the engaging part to the engaged part of the molded core provided side by side, and wherein the second cutting part is cut at the flange part.

3. The method for cutting a molded core according to claim 1, wherein on the resin covering part, a connecting member projects toward the inner peripheral side at a position continuous to the main body-side second end face when cut, the connecting member having an end extending to a center of the molded core that extends in the direction parallel to an axial core of the molded core, wherein one surface is a projection shaft and the other surface has a shaft hole into which the projection shaft is fitted, and wherein the projection shaft of the connecting member is connected to the shaft hole of the molded core provided side by side when the plurality of molded cores are coupled.

4. The method for cutting a molded core according to claim 1, wherein one or more ribs project from the side surface of the resin covering part and the ribs are made to abut on the side surface of the molded core provided side by side when the plurality of molded cores are coupled.

5. The method for cutting a molded core according to claim 4, wherein the resin covering part has a configuration wherein each area around the ribs is thinly formed, and wherein the ribs are cut by pushing the ribs after the molded core is cut.

6. The method for cutting a molded core according to claim 1, wherein the magnetic body is a powder compression molded body made of a magnetic material, and wherein the resin covering part is formed by an insert-molding method or a resin powder coating method.

* * * * *